United States Patent [19]

Palsson

[11] Patent Number: 4,732,562

[45] Date of Patent: Mar. 22, 1988

[54] DEVICE FOR USE IN THE THAWING OF FROZEN DOOR LOCKS

[76] Inventor: Johannes S. Palsson, Taastrupgaardsvej, 177, DK-2630 Taastrup, Denmark

[21] Appl. No.: 31,837

[22] Filed: Mar. 30, 1987

Related U.S. Application Data

[63] Continuation-in-part of Ser. No. 841,762, Mar. 20, 1986, abandoned.

[30] Foreign Application Priority Data

Sep. 30, 1985 [DK] Denmark ..... 4419/85

[51] Int. Cl.[4] ..... F26B 21/00; F24J 3/00; E05B 17/00

[52] U.S. Cl. ..... 432/224; 98/31; 34/104; 70/423; 70/424; 70/431

[58] Field of Search ..... 432/224; 98/31; 34/104; 70/423, 424, 455, 431

[56] References Cited

U.S. PATENT DOCUMENTS

| | | | |
|---|---|---|---|
| 460,291 | 9/1891 | Jung | 34/224 |
| 2,614,337 | 10/1952 | Darbo | 34/104 |
| 3,417,482 | 12/1968 | Peet | 34/104 |
| 3,691,647 | 9/1972 | Snyder et al. | 34/104 |
| 3,805,405 | 4/1974 | Ambos | 98/31 |
| 4,058,995 | 11/1977 | Greaves | 70/431 |
| 4,090,379 | 5/1978 | Lehner | 70/455 |

FOREIGN PATENT DOCUMENTS

| | | |
|---|---|---|
| 2910577 | 9/1980 | Fed. Rep. of Germany . |
| 7607670 | 8/1979 | Sweden . |

*Primary Examiner*—Henry C. Yuen
*Attorney, Agent, or Firm*—Holman & Stern

[57] ABSTRACT

A device for use in thawing frozen car locks comprises a tube (10) of a heat insulating material having a plug support at one end; axial holes through the plug support; a flat, axially projecting plug (13) extending from the plug support designed to be inserted into and to essentially fill the keyhole of the lock; and a raised lip on the plug end formed with a plurality of through-going, radial cuts (15). When the projection is inserted into the keyhole in a frozen lock, and expiration air is blown into the other end of the tube, this air gives off its heat to the outer side of the lock before flowing through the openings without itself penetrating into the lock. The heat, on the other hand, is conducted into the lock and melts ice formed therein.

18 Claims, 4 Drawing Figures

DEVICE FOR USE IN THE THAWING OF FROZEN DOOR LOCKS

This application is a continuation-in-part of co-pending application Ser. No. 841,762 filed on Mar. 20, 1986, now abandoned.

BACKGROUND OF THE INVENTION

1. Field of the Invention

This invention relates to a device for thawing frozen door locks, particularly car door locks.

2. Description of the Prior Art

To thaw frozen car door locks it is known to use lock oil supplied in small compressible containers with a thin outlet spout which can be inserted into the keyhole. Another known means for this purpose is small electric heating elements which can be connected to a battery. Both of these means have the drawback that they are often not available when needed, e.g. because they are present in the locked car. To this should be added, at least as far as the heating element is concerned, that it is relatively expensive and troublesome to use.

German Patent Specification No. 29 10 577 discloses a device comprising a bent tube one end of which is intended to be placed over and surround a door lock so that the heat from a cigarette lighter for example placed in the other end will be conducted through the tube to the door lock. Besides requiring the use of a lighter, this device may be difficult to use in case of windy weather.

U.S. Pat. No. 4,058,995 discloses a device consisting of a heat insulating telescopically collapsible tube for blowing expiration air onto and into a door lock, so that the heat of said air may be utilized to melt ice in the lock. However, expiration air contains a relatively great amount of water vapor which may give rise to corrosion of the inner plate of the lock.

BRIEF SUMMARY OF THE INVENTION

It is an object of this invention to provide a device for thawing frozen door locks, such as car door locks, which is easy to store so that it is always available, has no moving parts, and is inexpensive to manufacture and easy to use.

The present invention provides such a device for thawing a frozen door lock and comprises a tubular member of heat insulating material; a plug element at one end of the tubular member adapted for insertion into the keyhole of the door lock; a support element adjacent the one end of the tubular member, the plug element extending from the support means; and means for guiding air blown into the other end of the tubular member onto the door lock so that heat from the air is conducted through the door lock to thaw any frozen matter herein; the support element being arranged to provide axial openings permitting air to leave the tube at both sides of the plug element.

The plug element of the device prevents at least substantially the expiration air from penetrating into the inside of the door lock, while still heating the outside of the lock, from which the heat propagates into the lock and thaws disturbing ice formations.

BRIEF DESCRIPTION OF THE DRAWINGS

The invention will now be explained more fully below with reference to the accompanying drawing, wherein.

DETAILED DESCRIPTION

Figures 1, 2, 3:
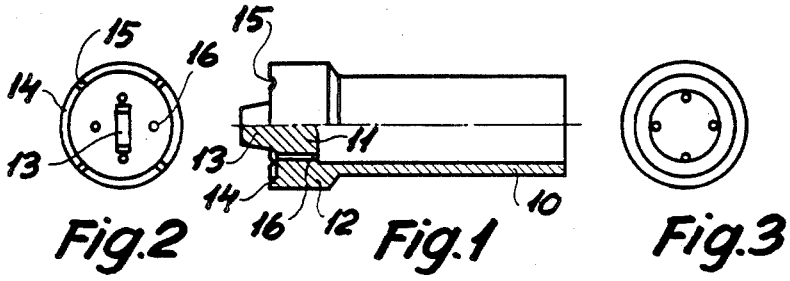
FIG. 1 is a side elevational and partially cross-sectional view of an embodiment of the device according to the invention.
FIG. 2 is a left end view of FIG. 1.
FIG. 3 is a right end view of FIG. 1.

In the embodiment of FIGS. 1, 2 and 3, the numeral 10 designates a substantially cylindrical tube consisting of a heat insulating material, such as e.g. a plastics material. The tube is open at one end and has at its other end a bottom, or closure, 11 and a portion of increased diameter forming a collar 12. The bottom is formed to have a flat, trapezoidal, axially outwardly directed projection forming a plug means 13 intended for insertion into the keyhole of a car door lock. The collar 12 has along its radially outer end edge an annular, relatively short axial flange 14, or lip formed with a plurality, e.g. four, of radially through-going cut-outs, or grooves, to provide openings through the lip when pressed against the lock. The bottom 11 is formed with axial through-going holes 16 in the spaces between these cuts.

In use of the device, the plug means 13 is inserted into the keyhole in the frozen lock until the edge of the flange 14 is in plane engagement with the outer side of the lock, and then the user blows into the tube 10. The warm expiration air flows through the holes 16 and along the outer side of the lock out through the grooves 15. The plug means essentially fills the keyhole so that, at most, a very small portion of the expiration air penetrates into the lock. On the other hand, the heat from the outer side of the lock heated by the air propapates into the lock and melts the ice in it. The grooves 15 in the flange edge throttle the flow path of the expiration air so that the air gives up almost all its heat to the lock before escaping into the atmosphere.

Figure 4:
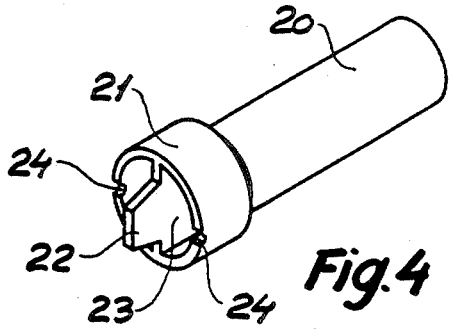
FIG. 4 is a perspective view showing a second embodiment of the invention.

Similar to the above described device the embodiment shown in FIG. 4 consists of a heat insulating tube 20 open at one end and having at the other end an enlarged collar 21. A trapezoidal plug element 22 extends axially from a diagonally extending support means 23 provided in the end portion of the collar 21. The outer edge of the collar is provided with through-going cuts 24. The device of FIG. 4 is used and works in the same way as that shown in FIGS. 1–3 and described above.

The details of the device shown and described in the foregoing may be modified in several ways within the scope of the invention. For example, the tube does not have to be cylindrical, but may optionally be prismatic, and both the number and location of the holes 16 and the grooves 15 may be varied. If a hard plastics material is used, a softer seal ring may be fitted on the edge of the flange 14. The grooves 15 may optionally be replaced by holes. Further, the device may be equipped with an eye or the like making it possible to connect the device to a key ring. Another possibility is to connect the inlet of the tubular part of the device to a hose so that the user does not have to bend to blow into the tube.

I claim:

1. A device for thawing a frozen door lock having a keyhole comprising:

a tubular member of heat insulating material;

plug support means in and adjacent to one end of said tubular member;

plug means at said one end of said tubular member extending outwardly from said plug support means and having a shape to facilitate insertion thereof into the keyhole of the door lock; and means for guiding air blown into the other end of said tubular member onto the door lock so that heat from said air is conducted through the door lock to thaw any frozen matter therein comprising said plug support means being shaped to provide axial openings at both sides of said plug means for the passage of air therethrough.

2. A device as claimed in claim 1 wherein:

said plug means has a substantially trapezoidal shape.

3. A device as claimed in claim 1 wherein:

said plug support means comprises a closure member; and said axial openings comprise aperture means through said closure member on both sides of said plug means.

4. A device as claimed in claim 3 wherein:

said plug means has a substantially trapezoidal shape.

5. A device as claimed in claim 3 wherein:

said plug means comprises a blade-shaped member protruding from said one end of said tubular member and having substantially flat faces on said sides and opposite edges; and said axial openings further comprise further aperture means through said closure member adjacent said opposite edges.

6. A device as claimed in claim 4 wherein:

said plug means comprises a blade-shaped member protruding from said one end of said tubular member and having substantially flat faces on said sides and opposite edges; and said axial openings further comprise further aperture means through said closure member adjacent said opposite edges.

7. A device as claimed in claim 1 wherein:

said tubular member is substantially cylindrical.

8. A device as claimed in claim 6 wherein:

said tubular member is substantially cylindrical.

9. A device as claimed in claim 1 and further comprising:

an annular lip on said one end of said tubular member adapted to engage against the door lock in use; and wherein said means for guiding air further comprises at least one radial opening through said annular lip.

10. A device as claimed in claim 3 and further comprising:

an annular lip on said one end of said tubular member adapted to engage against the door lock in use; and wherein said means for guiding air further comprises at least one radial groove through the outer edge of said annular lip.

11. A device as claimed in claim 5 and further comprising:

an annular lip on said one end of said tubular member adapted to engage against the door lock in use; and wherein said means for guiding air further comprises at least one radial opening through said annular lip.

12. A device as claimed in claim 1 and further comprising:

an enlarged diameter section on said tubular member extending from said one end toward said other end a short distance less than half the length of said tubular member.

13. A device as claimed in claim 2 and further comprising:

an enlarged diameter section on said tubular member extending from said one end toward said other end a short distance less than half the length of said tubular member.

14. A device as claimed in claim 3 and further comprising:

an enlarged diameter section on said tubular member extending from said one end toward said other end a short distance less than half the length of said tubular member.

15. A device as claimed in claim 11 and further comprising:

an enlarged diameter section on said tubular member extending from said one end toward said other end a short distance less than half the length of said tubular member.

16. A device as claimed in claim 14 and further comprising:

an annular lip on said one end of said tubular member adapted to engage against the door lock in use; and wherein said means for guiding air further comprises at least one radial groove through the outer edge of said annular lip.

17. A device as claimed in claim 1 wherein:

said tubular member is substantially straight.

18. A device as claimed in claim 16 wherein:

said tubular member is substantially straight.

* * * * *